US009836922B2

(12) United States Patent
Jackson

(10) Patent No.: US 9,836,922 B2
(45) Date of Patent: Dec. 5, 2017

(54) GAMING MACHINE AND PAYLINE SYSTEM WITH DUAL FUNCTION SPECIAL SYMBOLS

(71) Applicant: Kathleen Nylund Jackson, Scituate, MA (US)

(72) Inventor: Kathleen Nylund Jackson, Scituate, MA (US)

( * ) Notice: Subject to any disclaimer, the term of this patent is extended or adjusted under 35 U.S.C. 154(b) by 85 days.

(21) Appl. No.: 14/998,632

(22) Filed: Jan. 27, 2016

(65) Prior Publication Data

US 2016/0225221 A1 Aug. 4, 2016

Related U.S. Application Data

(60) Provisional application No. 62/125,760, filed on Jan. 30, 2015.

(51) Int. Cl.
*G07F 17/32* (2006.01)
*G07F 17/34* (2006.01)

(52) U.S. Cl.
CPC ..... *G07F 17/326* (2013.01); *G07F 17/329* (2013.01); *G07F 17/34* (2013.01)

(58) Field of Classification Search
USPC ..... 463/20
See application file for complete search history.

(56) References Cited

U.S. PATENT DOCUMENTS 5,931,467 A 8/1999 Kamille
6,319,124 B1 11/2001 Baerlocher
6,869,357 B2 3/2005 Adams et al.
6,966,835 B2 11/2005 Graham
7,070,502 B1 7/2006 Bussick et al.
7,326,113 B2 2/2008 Bennett et al.
7,494,413 B2 2/2009 Singer et al.
7,585,221 B2 9/2009 Singer et al.
7,601,062 B2 10/2009 Cole et al.
7,744,455 B2 6/2010 Aida
7,758,414 B1 7/2010 Marks et al.
7,775,881 B2 8/2010 Griswold et al.
7,819,740 B2 10/2010 Masci et al.
7,850,519 B2 12/2010 Majima et al.
7,878,903 B2 2/2011 Chan
8,002,625 B2 8/2011 Maya
8,128,480 B2 3/2012 Muir
8,216,053 B2 7/2012 Jaffe
8,241,107 B2 8/2012 Moroney
8,292,724 B2 10/2012 Marks et al.
(Continued)

*Primary Examiner* — Pierre E Elisca

(57) ABSTRACT

A method and apparatus for a video gaming machine is disclosed. The method comprises a player placing at least one wager in order to be eligible to activate at least one payline. A grid of symbol boxes is displayed on the screen. A random array of symbols is displayed within the symbol boxes from a predetermined set of symbols. The set of symbols includes at least one special symbol that has a dual functionality. Firstly, a special symbol acts as a non-valuable payline indicator symbol that determines a payline and activates the payline if the player has placed a wager on said payline. Secondly, the special symbol acts as a valuable wild symbol in any activated payline differing from the payline determined by its payline indicator functionality. The symbol array is evaluated, and wins are paid according to a predetermined paytable.

17 Claims, 12 Drawing Sheets

(56) References Cited

U.S. PATENT DOCUMENTS

| | | | | |
|---|---|---|---|---|
| 8,444,473 | B2 | 5/2013 | Ching et al. | |
| 8,851,976 | B2 | 10/2014 | Chan et al. | |
| 8,864,568 | B2 | 10/2014 | Mizue | |
| 8,864,570 | B2 | 10/2014 | Jackson | |
| 8,864,571 | B2 | 10/2014 | Gomez et al. | |
| 8,888,582 | B2 | 11/2014 | Louie et al. | |
| 9,017,161 | B2 | 4/2015 | Watkins | |
| 9,092,950 | B2 | 7/2015 | Kemper | |
| 9,093,307 | B2 | 7/2015 | Aoki et al. | |
| 9,171,428 | B2 | 10/2015 | Berman et al. | |
| 2007/0054726 | A1 | 3/2007 | Muir et al. | |
| 2007/0270208 | A1 | 11/2007 | Caspers et al. | |
| 2008/0039174 | A1 | 2/2008 | Litman | |
| 2008/0045324 | A1 | 2/2008 | Kato | |
| 2009/0054129 | A1 | 2/2009 | Yoshimura et al. | |
| 2009/0325678 | A1 | 12/2009 | Gomez | |
| 2010/0016054 | A1 | 1/2010 | Berman et al. | |
| 2010/0075741 | A1 | 3/2010 | Aoki et al. | |
| 2011/0207520 | A1 | 8/2011 | Berman et al. | |
| 2012/0046085 | A1 | 2/2012 | Lando | |
| 2013/0017881 | A1 | 1/2013 | Watkins | |
| 2013/0252704 | A1 | 9/2013 | Gilbertson et al. | |
| 2013/0303260 | A1* | 11/2013 | Louie | G07F 17/34 463/21 |
| 2013/0324208 | A1 | 12/2013 | Ryan | |
| 2013/0324215 | A1 | 12/2013 | Bramble et al. | |
| 2013/0324217 | A1 | 12/2013 | Gilbertson et al. | |
| 2013/0331183 | A1 | 12/2013 | Shai-Hee | |
| 2013/0337885 | A1 | 12/2013 | Suda et al. | |
| 2013/0344939 | A1 | 12/2013 | Aoki et al. | |
| 2014/0011565 | A1 | 1/2014 | Elias et al. | |
| 2014/0179400 | A1 | 6/2014 | Lee | |
| 2014/0221075 | A1 | 8/2014 | Lee | |
| 2014/0221079 | A1 | 8/2014 | Rucker et al. | |
| 2014/0274288 | A1* | 9/2014 | Hornik | G07F 17/326 463/20 |
| 2014/0274295 | A1* | 9/2014 | Poole | G07F 17/326 463/20 |
| 2014/0287814 | A1 | 9/2014 | Berman et al. | |
| 2014/0335928 | A1 | 11/2014 | Fujisawa et al. | |
| 2015/0011293 | A1 | 1/2015 | Gobe et al. | |
| 2015/0018071 | A1 | 1/2015 | Elias et al. | |
| 2015/0065224 | A1 | 3/2015 | Aoki et al. | |
| 2015/0072759 | A1 | 3/2015 | Hornik | |
| 2015/0356813 | A1 | 12/2015 | Mead et al. | |
| 2015/0363998 | A1 | 12/2015 | Comeau | |
| 2015/0379804 | A1 | 12/2015 | Casey | |
| 2015/0379807 | A1 | 12/2015 | Zhang | |
| 2017/0148254 | A1* | 5/2017 | Hornik | G07F 17/3213 |

* cited by examiner

GAMING MACHINE AND PAYLINE SYSTEM WITH DUAL FUNCTION SPECIAL SYMBOLS

RELATED APPLICATION DATA

This Application claims priority from U.S. Provisional Patent Application Ser. No. 62/125,760, filed Jan. 30, 2015, and having the Title GAMING MACHINE AND PAYLINE SYSTEM WITH DUAL FUNCTION SPECIAL SYMBOLS.

BACKGROUND OF THE INVENTION

1. Field of the Invention

The present invention relates to a video slot symbol game and apparatus suitable for use in casinos and other gaming enterprises. The invention further relates to video gaming play that provides a special symbol that may function as both a non-valuable payline indicator/activator and a valuable enhanced symbol.

2. Background of the Art

Video slot games have grown exponentially in numbers in the last twenty years, as have the revenues generated by such devices. It is estimated that more than 70% of any casino's revenue are now provided by gaming machines as opposed to table games.

In the gaming industry, there is a continuous need for innovative game features that will attract new players as well as keep regular players amused and therefore willing to continue playing the game. Since in virtually every casino game there is a house advantage, the longer a player remains playing at a machine, the larger the casino's profit. And since it is well recognized in the industry that players tend to easily tire of playing the same games over and over again, manufacturers must constantly develop new game features to stimulate player interest.

The majority of today's slot machines are video slots, particularly 5-column×3-row multiline video slots. The most typical play method of these multiline slots provides multiple paylines that comprise five symbols, one symbol in each column, with each payline beginning in the left-hand column. The symbols may or may not be connected horizontally or diagonally across the columns. Unlike the original 9-payline format, newer machines may offer up to 243 paylines. (Since each payline requires a separate bet, these newer machines can provide meaty wagers for the house on even penny machines.) One of the drawbacks of this game play is that the player is often confused by the large amount of paylines that zigzag and overlap. In addition, each payline has a different configuration. While the player is happy to win, he does not necessarily know when he wins or why he wins. And understanding when and why one wins adds to the anticipation that is the fundamental of gaming. There is a need to provide multiple paylines that are easy to anticipate and understand while providing additional incentives to play, such as special symbols.

Prior art has taught various methods of providing novel and/or additional paylines and special symbols. U.S. Pat. No. 8,241,107 (Moroney) discloses a method for use with a gaming machine arranged to provide a spinning reel game in which symbols are spun up on a plurality of reels to form at least one outcome and, if a winning outcome occurs, the gaming machine awards an award. The method includes (a) if at least one specified symbol is spun up and displayed in a resultant position on a reel, holding the specified symbol in the resultant position for at least one further game in which at least the reel carrying the specified symbol is re-spun; and (b) awarding the award if a winning outcome occurs, wherein a specified symbol comprising part of a winning outcome has the effect of increasing the award if the specified symbol is adjacent at least one other specified symbol. U.S. Pat. No. 8,128,480 (Muir) describes a method wherein at least one and preferably a plurality of the symbols are reflector symbols. A reflector symbol is a symbol that, when generated on one of the reels, causes any payline which runs through such symbol to be reflected back across one or more of the reels to form a supplemental payline. U.S. Pat. No. 7,494,413 (Singer, et al.) discloses a gaming device that forms at least one bonus payline with any bonus payline symbols indicated on the reels and evaluates the symbols indicated on the bonus payline to determine if the bonus payline indicates any winning symbol combinations. U.S. Pat. No. 6,966,835 (Graham) teaches a method wherein a special symbol, when a payline passes through that special symbol, causing the payline to split into a main payline and at least one branch payline. U.S. Application No. 20140148242 (Berman, et al.) discloses a gaming device comprising: a display configured to show a grid formed by a plurality of elements; and a processor configured to: mark each of the plurality of elements with one of a plurality of markings, where at least one of the plurality of markings is a feature marking, position a plurality of feature indicators between adjacent elements forming the grid, indicate elements that have a feature marking and are adjacent to a feature indicator, re-mark elements that are adjacent to the indicated elements when a feature indicator is positioned between the elements and the adjacent indicated elements, respectively, and determine an outcome based on one or more combinations of the markings. U.S. Application No. 20140066169 (Watkins) discloses a gaming system, apparatus, and method with one or more additional payline awards made through special symbols appearing in the game. The number of additional paylines is determined based at least on the special symbol present. U.S. Application No. 20130344939 (Aoki; Dion K., et al.) teaches a method that includes displaying, on at least one display device, a randomly selected outcome of a wagering game in a display area. The display area includes a plurality of reels with a plurality of symbols forming an array. The plurality of symbols includes at least one special symbol. In response to the randomly selected outcome including a special symbol on adjacent ones of the plurality of reels, the method includes changing the functionality of the special symbols on the adjacent ones of the plurality of reels to create a modified array. U.S. Application No. 20130017881 (Watkins) discloses a game that includes a special wild symbol that applies a transformation field to other symbols around it. The effect of this transformation field is to change the symbols into wild symbols. U.S. Application No. 20100075741 (Aoki; Dion K., et al.) teaches a gaming system that includes at least one display for displaying an array of symbols indicating a randomly selected outcome. The array of symbols includes a plurality of rows and a plurality of columns. The symbols include directional indicators. The randomly selected outcome is indicated by at least one sequence of symbols formed based on directions associated with the directional indicators. U.S. Application No. 20090325678 (Gomez) describes a gaming system for conducting a wagering game that includes a plurality of reels with symbols forming an array. The symbols include a directional wild symbol having a direction indicator. The controller is coupled to the display and operative to (i) display the directional wild symbol on the display, (ii)

provide a wild function to a symbol that is adjacent to the directional wild symbol and at a certain orientation relative to the directional wild symbol as indicated by the direction indicator, and (iii) provide an award based on the array with the adjacent symbol having the wild function.

Despite the above referenced prior art, there remains a need for gameplay providing both paylines that all have the same configuration and special symbols that may enhance the chance to win or provide larger wins in order to increase player anticipation and participation.

SUMMARY OF THE INVENTION

The present invention discloses a method of playing a video wagering game on a video gaming apparatus, the apparatus having at least one processor, at least one input device, memory and video display screen. The method comprises the processor accepting a wager in response to the at least one input device by a player on the video wagering game in order to be eligible to activate an at least one payline. A predetermined amount of connected identical symbol boxes in a grid are displayed on the video display screen. A random array of symbols is displayed within the symbol boxes from a predetermined set of symbols. The predetermined set of symbols includes at least one special symbol, wherein the special symbol comprises a dual functionality. A first functionality of the special symbol is to act as a non-valuable payline indicator symbol that determines one payline and activates said one payline if the player has placed a wager on said payline. A second functionality of the special symbol is to act as a valuable wild, multiplier, scatter and/or bonus symbol in any activated payline differing from the said one payline determined by its payline indicator functionality. The symbol array is evaluated, and any wins are paid according to a predetermined paytable.

DETAILED DESCRIPTION OF THE INVENTION

Figure 1:
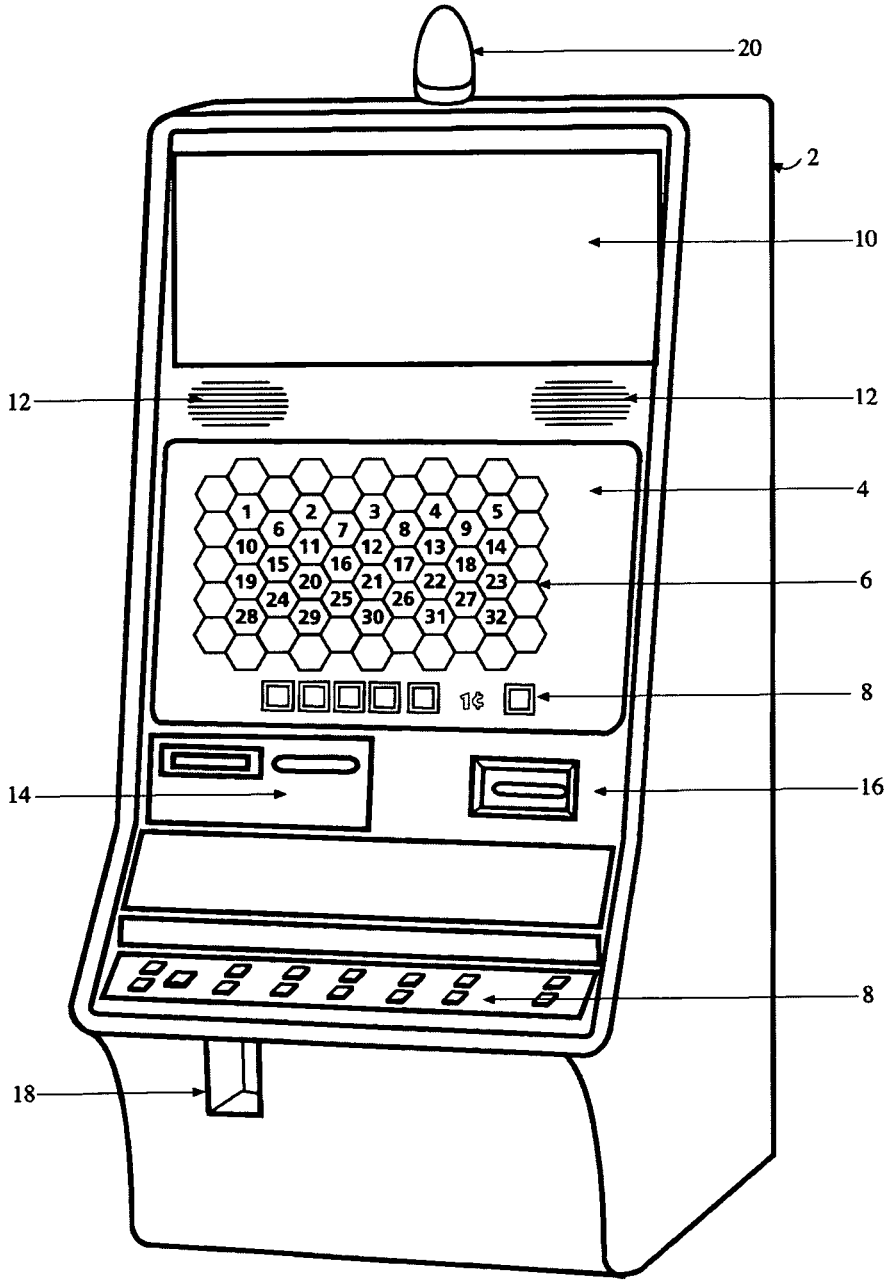
FIG. 1 shows a first gaming device capable of executing the present invention.

The technology of the present application includes a method of playing a video wagering game having identically-configured paylines and special symbols. The said game is played on an electronic gaming machine (EGM). A standard EGM having a housing, video display monitor, processor and a memory in communication with the processor (internal or through an I/O port to a distal memory) may be used to support the game. The method effected and steps performed on the EGM would include at least some of:

the processor accepting a wager by a player on the video wagering game;

displaying on the video display screen a random set of symbols used in the play of a wagering game (the display signals generated by the processor and/or memory); and the processor determining an outcome on the wagering game based on the random set of symbols (which symbols may be electronically mapped on virtual reels and/or selected from sets of symbols by an electronic random number generator).

A video gaming apparatus comprises a housing, a video display monitor in the housing, a processor in the housing and a memory in communication with the housing, wherein the processor and memory are configured to perform the methods described above and herein and to cause the symbols of the video wagering game to be displayed on the video display screen.

A gaming system comprises a wager input device and at least one display for displaying a video wagering game, the wagering game comprising at least an underlying base game. At least one processor and controller are operative to detect receipt of at least one wager from a first player via the wager input device.

The present invention can be implemented using a variety of different processing apparatuses. Preferably, the invention is implemented using a computer to determine game operations, implement game rules, and perform accounting functions on wagers and outcomes. A typical computer includes a central processing unit connected to a memory. The computer has connected thereto other devices such as display screen, buttons and/or a touch screen input device, one or more front panel buttons used in the operation of the machine; a coin, credit, token, or card acceptor for allowing a player to place bets; a network card for connecting the computer to an optional central computer, and security system connections. The central computer may be used for accounting, bookkeeping, and/or security purposes, or for downloading new game software or game software upgrades to computer, and/or for controlling the operation of the game via a network. In one optional embodiment, the computer includes a memory having a more permanent first portion in which is stored the software for running games on a CPU. This more permanent memory may be a hard disk read only memory (ROM), erasable programmable read only memory (EPROM), an application specific integrated circuit (ASIC), field programmable gated array (FPGA) or even a feed through a network to a localized or central memory. A thin client network from the central computer or local game computer to the individual gaming device may alternatively be provided. All of these integrated circuit storage means are well known in the art so are not discussed further. The advantage to providing all game logic via a stored program on hard disk, or via network card from a central computer is that a game may quickly and easily be updated, or a different game program be loaded to run on the computer without having to change any integrated circuit chips, such as the ROMs, EPROMs or ASICs. When game software remains on the central computer, it permits games to be played over a local network, or over a remote network which may include the Internet. The memory also has a second portion used in playing the games. The second memory would be typically a random access memory (RAM) with memory locations associated with each of the primary game positions, secondary game positions, secondary game progressives, information display areas and soft buttons on a display. These memory locations store information about the game symbols displayed, the bets placed, winnings, the speed of the game, etceteras. Alternatively, individual game software may not be permanently stored in memory. When a player touches a game selection button, or reel set selection button or control, and a game or reel sets is selected for a game, the request may be transmitted via network or network card to a central computer and the game software is downloaded to the more permanent memory to be used by the CPU to run the game or reel set chosen by the player. This permits central control of the games to be played on specific machines, fast upgrades of game software and easier addition of software for new games.

In a further non-limiting configuration, one or more of the players can be located in separate locations, and the player terminals or hand-held devices or player screens in rooms can be connected to the controller via communication links (e.g., hardwired or wireless). Standard protocols, software, hardware and processor languages may be used in these communication links, without any known limitation. There are hundreds of available computer languages that may be used, among the more common being Ada; Algol; APL; awk; Basic; C; C++; Cobol; Delphi; Eiffel; Euphoria; Forth; Fortran; HTML; Icon; Java; Javascript; Lisp; Logo; Mathematica; MatLab; Miranda; Modula-2; Oberon; Pascal; Perl; PL/I; Prolog; Python; Rexx; SAS; Scheme; sed; Simula; Smalltalk; Snobol; SQL; Visual Basic; Visual C++; and XML.

Any commercial processor may be used either as a single processor, serial or parallel set of processors in the system. Examples of commercial processors include, but are not limited to Merced™, Pentium™, Pentium II™, Xeon™, Celeron™, Pentium Pro™, Efficeon™, Athlon, AMD and the like.

Display screens may be segment display screen, analog display screens, digital display screens, CRTs, LED screens, plasma screens, liquid crystal diode screens, and the like.

In a first preferred embodiment of the present invention, a method of video slot play comprises identically-configured paylines and special symbols. The method comprises a processor accepting a wager in response to at least one input device by a player on a video wagering game in order to be eligible to activate an at least one payline. A honeycomb grid comprised of a predetermined amount of connecting hexagonal symbol boxes is provided on a video display screen. Each symbol box that is fully surrounded by six adjacent symbol boxes is designated as a potential payline indicator symbol box. Upon the wager (cash, monetary credits, monetary tokens, non-monetary credits, non-monetary tokens and the like), a random array of symbols is provided within the symbol boxes from a predetermined set of symbols used in the play of the wagering game. The predetermined set of symbols includes at least one special symbol, wherein if a special symbol is provided in a potential payline indicator symbol box, that said special symbol comprises a dual functionality. A first functionality of the special symbol is to act as a non-valuable payline indicator symbol that determines one payline and activates said one payline if the player has placed a wager on said payline. It is preferred that the special symbol is an alphanumeric symbol. A second functionality of the special symbol is to act as a valuable enhanced symbol such as a wild, multiplier, scatter and/or bonus symbol in any activated payline differing from the said one payline determined by its payline indicator functionality.

Each hexagonal symbol box that is fully surrounded by exactly six connecting hexagonal symbol boxes determines one payline. The said one payline comprises the said six connecting hexagonal symbol boxes, preferably beginning first with the symbol box directly above the potential payline indicator symbol box, then continuing clockwise diagonally down to the right to the second symbol box, then vertically down to the third symbol box, then diagonally down to the left to the fourth symbol box, then diagonally up to the left to the fifth symbol box, then finally vertically up to the sixth symbol box. A payline is only indicated if a special symbol is displayed within a potential payline indicator symbol box, and the payline is only activated if the player has made a wager on said payline.

If a special symbol is displayed in an activated payline, the said special symbol may be changed to an enhanced symbol. It is preferable that the enhanced symbol may be a wild symbol, although it is contemplated that the enhanced symbol may instead be a multiplier, a wild multiplier, a scatter symbol, a bonus symbol, or the like.

Each activated payline is evaluated by the processor, and wins are provided for predetermined symbol combinations beginning with the first symbol box of the payline. Symbol combinations may comprise at least like symbols (identical icons, for example), symbols that comprise an order (1,2,3, 4,5,6 or a,b,c,d,e,f, for example), related symbols (types of animals with their corresponding habitats or homes, for example), and partial symbols that provide a whole (puzzle pieces, for example). Any wins are paid according to a predetermined paytable.

In a second preferred embodiment of the present invention, the method of the first embodiment is utilized, except additional paylines may be added. Each hexagonal symbol box that is surrounded by exactly six connecting hexagonal symbol boxes determines at least two paylines. The said at least two paylines each comprise at least two connecting symbol boxes from the said six connecting hexagonal symbol boxes, although it is preferred that each payline comprises exactly five symbol boxes. Each payline may begin with any symbol box of the six connecting hexagonal symbol boxes, and continue either clockwise or counter-clockwise.

In a third preferred embodiment of the present invention, a grid is provided on a video display screen, the grid comprising square symbol boxes that are arranged in at least a 3 3-column×3-row configuration. Preferably, a 5×5 grid is provided, with nine potential payline indicator symbol boxes that are each fully surrounded by eight adjacent (one above, one below, one right, one left and four diagonally disposed) symbol boxes. Each potential payline indicator symbol box determines at least one payline. Each payline may be comprised of two up to and including eight symbol boxes. Preferably, each potential payline indicator symbol box determines four paylines: a first payline of five connecting symbol boxes beginning with the symbol box directly above the payline indicator symbol box and continuing clockwise, a second payline of five connecting symbol boxes beginning with the symbol box to the right of the payline indicator symbol box and continuing clockwise, a third payline of five connecting symbol boxes beginning with the symbol box directly below the payline indicator symbol box and continuing clockwise, and a fourth payline of five connecting symbol boxes beginning with the symbol box directly to the left of the payline indicator symbol box and continuing clockwise. Alternately, it should be noted that each payline may comprise two, three, four, six, seven or eight symbol boxes and/or begin with any symbol box of the eight connecting symbol boxes, and continue either clockwise or counter-clockwise.

Those trained in the art will appreciate that these play options are exemplary and are not intended to dictate an exclusive method of play, nor limit or restrict specific gameplay.

Reference to the Figures will assist in further understanding of the practice of the present invention.

FIG. 1 illustrates a gaming machine that includes at least a cabinet 2 and monitor screen 4 capable of displaying a video gambling game 6. The video gambling game comprises at least a symbol game and touchscreen buttons and/or physical buttons 8 that enable a player to play the video wagering game. An additional video monitor screen 10 may be provided, upon which game theme graphics may be displayed. The gaming machine or apparatus preferably also includes speakers 12, and a value input/output device 14 that allows a player to insert value for game play or extract value of said game play. A separate device 16 is provided that preferably enables a player card or ticket to be inserted for the purpose of keeping track of player information, providing information of benefits or events, and the like. In rarer or older examples, a coin output device 18 may be provided. An electronic signaling device 20 may be apportioned on the top of the gaming machine to signal information of wins or needs to the appropriate people or employees.

Figure 2:
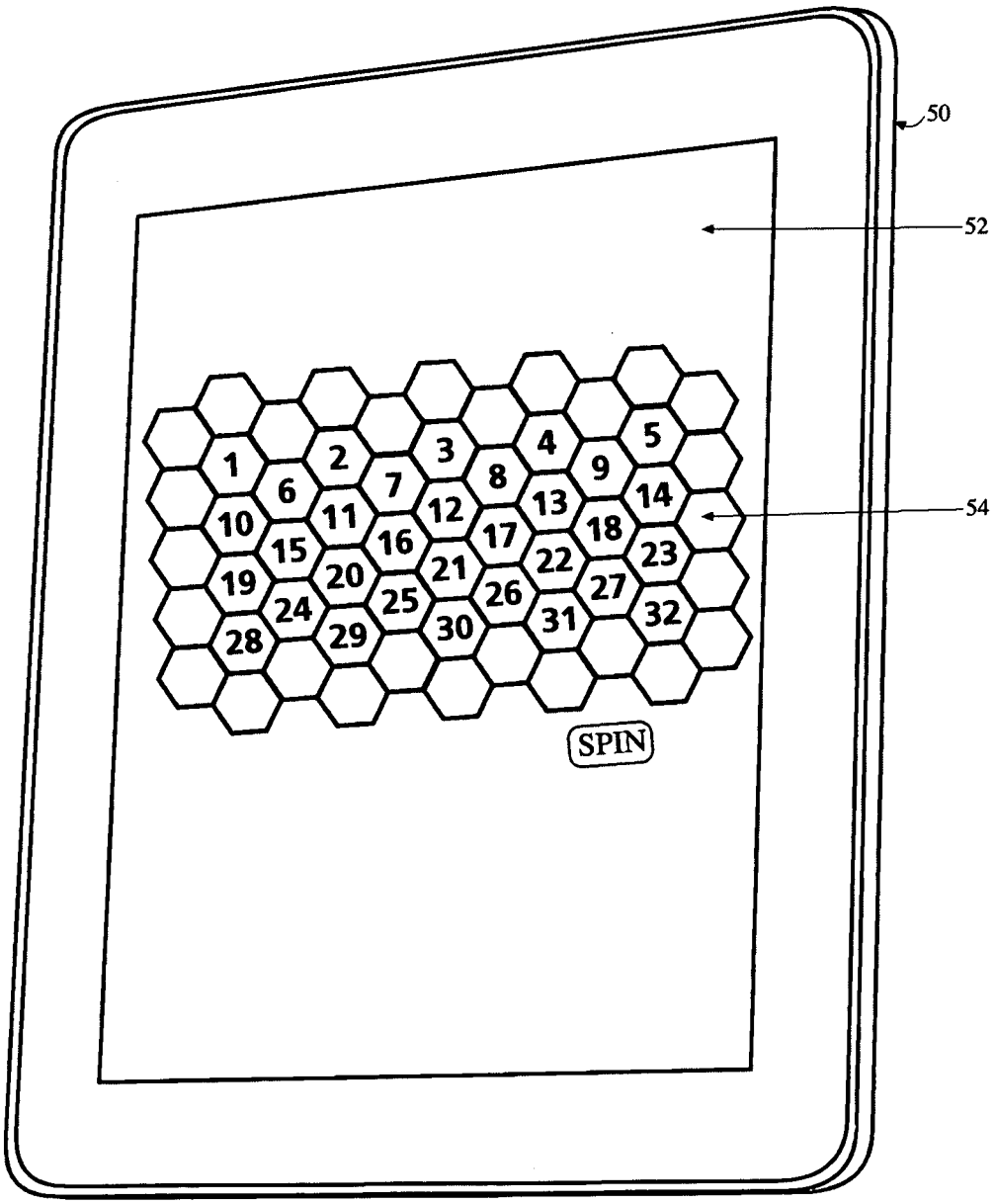
FIG. 2 shows a second device capable of executing the present invention.

FIG. 2 illustrates an alternate device 50 capable of displaying and playing a video wagering game 54 on a screen monitor 52. Alternate devices may include at least a desktop computer, a laptop computer, an iPad®-like device, or an iPhone®-like device.

Figure 3:
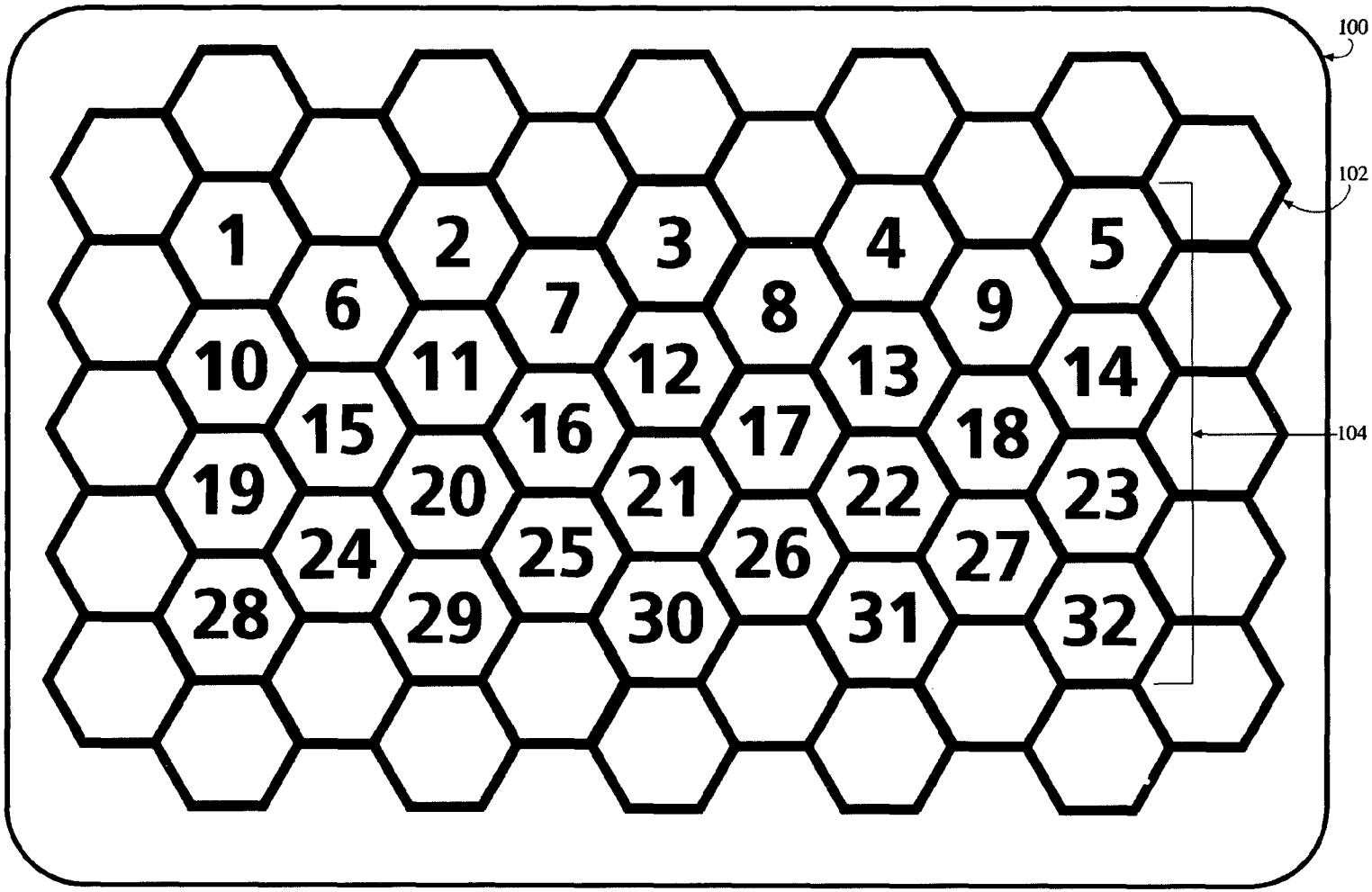
FIG. 3 shows a monitor screen of a slot machine with a depiction of 32 potential payline indicator symbol boxes.

FIG. 3 illustrates the first embodiment of the present invention and shows a slot machine monitor screen 100 with a honeycomb grid comprised of sixty connected hexagonal symbol boxes 102. Thirty-two of the symbol boxes are labeled 1 through 32 inclusive, and represent thirty-two different potential payline indicator symbol boxes 104.

Figure 4:
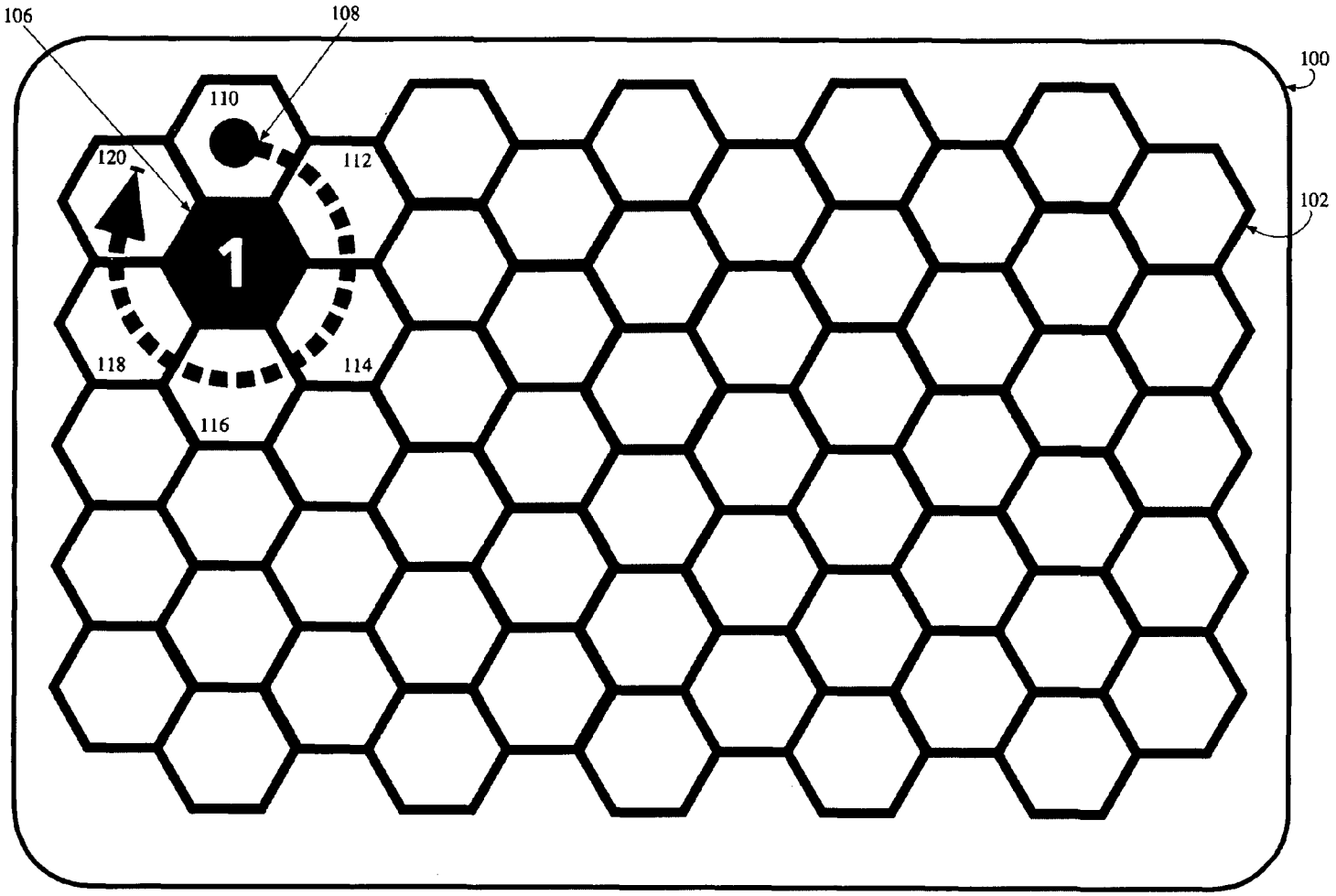
FIG. 4 shows the monitor screen of the slot machine with an illustrative example of a special symbol and its corresponding activated payline comprising six symbol areas.

FIG. 4 refers to the game elements shown in FIG. 3 and displays an exemplary payline configuration. A special symbol (solid black hexagon designated by white type "1") 106 acts first as a payline indicator and is designated by white type "1" since it has been placed in the potential payline indicator symbol box "1". The corresponding activated payline 108 is shown, comprising the six adjacent surrounding symbol boxes (110, 112, 114, 116, 118, 120).

Figure 5:
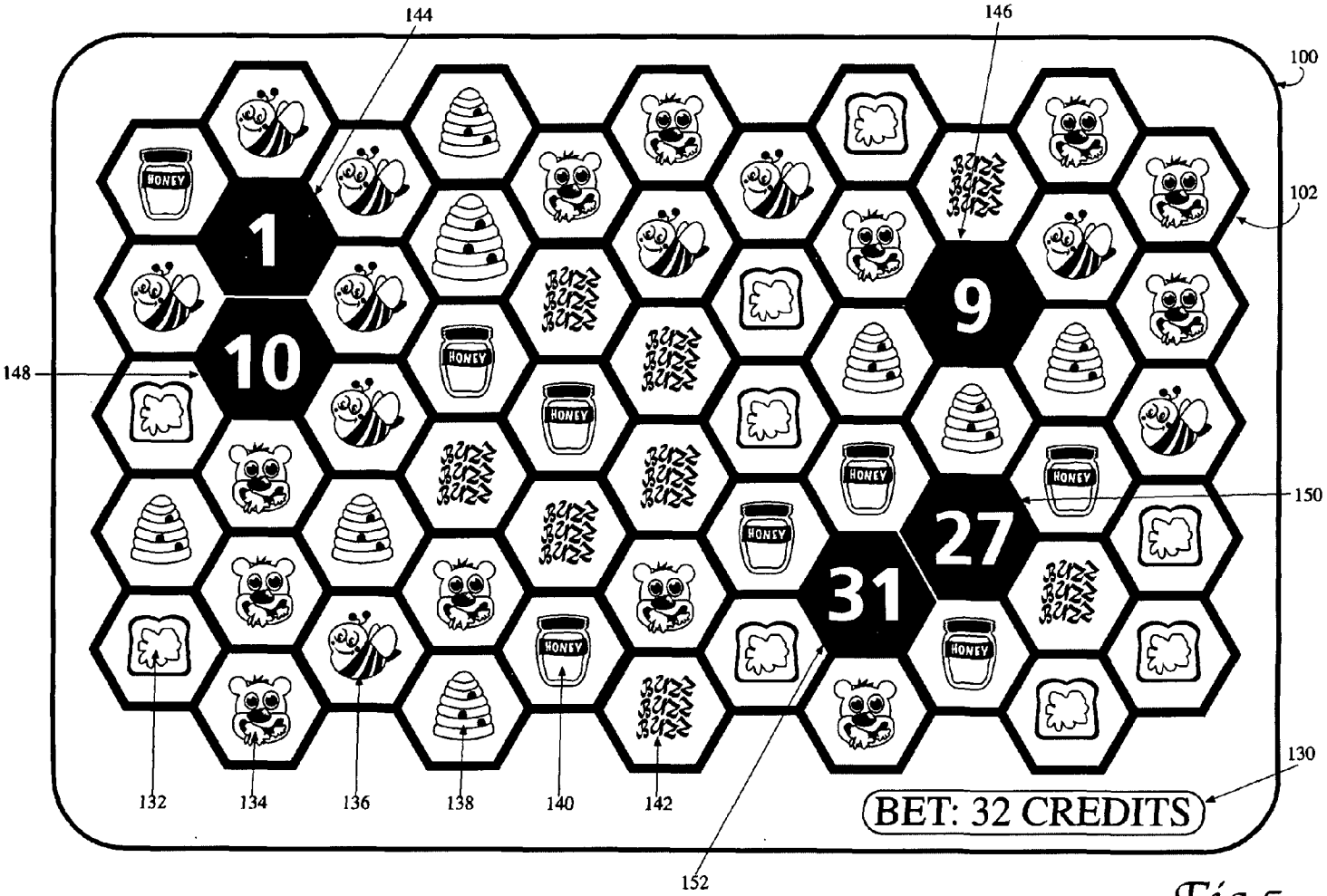
FIG. 5 shows a result of a wagered spin of a video slot game comprising various symbols and including five special symbols.

FIG. 5 shows the monitor screen 100 with the honeycomb grid 102 being populated by various amounts of different game symbols after a wager of 32 credits has been placed 130 in order to be eligible to play Paylines 1 through 32 (see FIG. 3). The game symbols comprise Honey Toast 132, Honey Bear 134, Mr. Bee 136, Beehive 138, Honey Jar 140, Buzz-Buzz 142, and special symbols "1" 144, "9" 146, "10" 148, "27" 150 and "31" 152.

Figure 6:
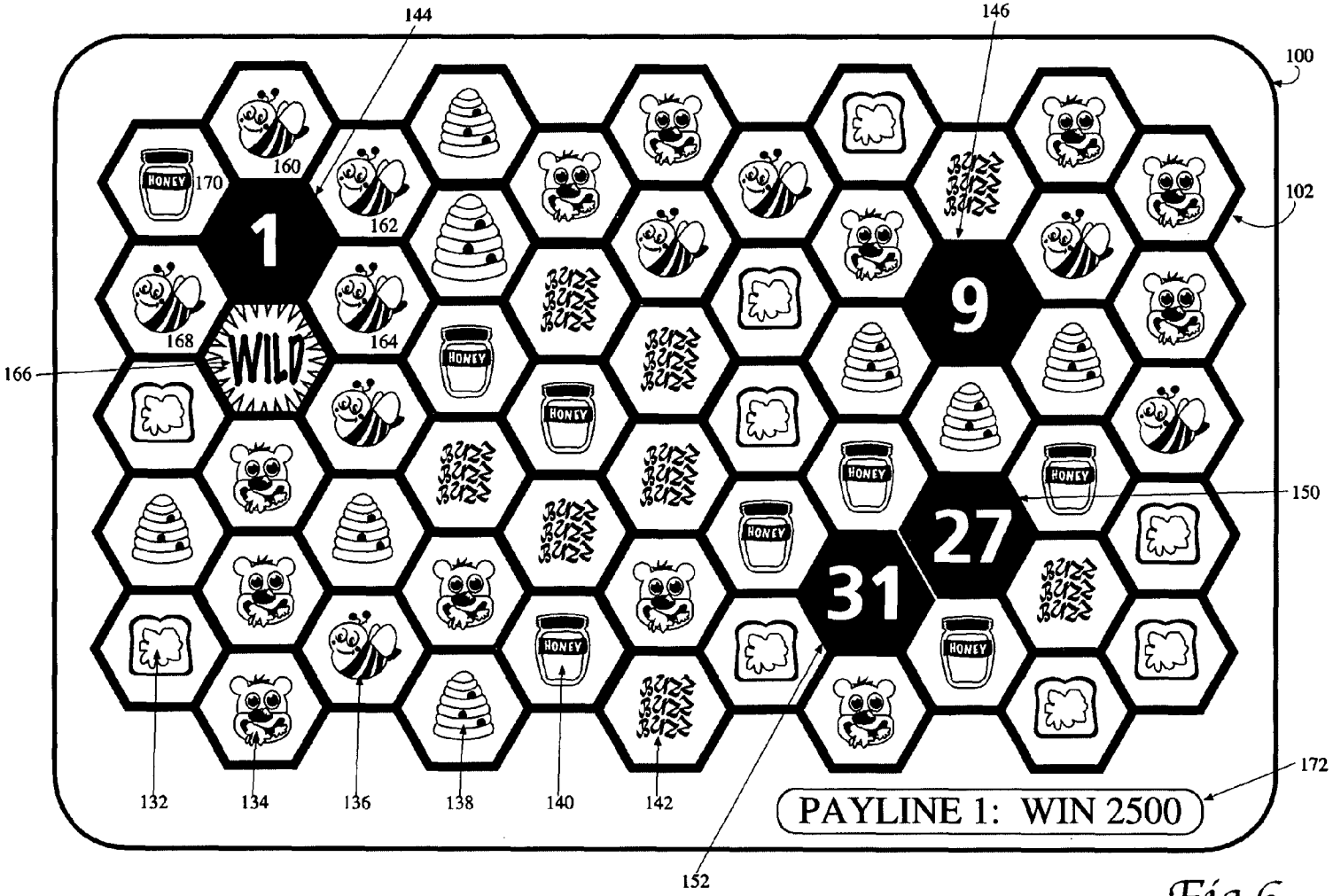
FIG. 6 shows the first special symbol indicating and activating its corresponding payline.

FIG. 6 refers to the game elements shown in FIG. 5 with special symbol "1" 144 indicating and activating Payline 1 comprising symbol boxes 160, 162, 164, 166, 168 and 170. The first symbol box in Payline 1 160 contains a Mr. Bee, the second symbol box 162 contains a Mr. Bee, the third symbol box 164 contains a Mr. Bee, the fourth symbol box 166 is special symbol "10" (activating Payline 10) that has been changed to a Wild symbol in Payline 1, the fifth symbol box 168 contains a Mr. Bee, and the sixth symbol box 170 contains a Honey Jar. The player wins 2500 credits for five Mr. Bees on Payline 1 172 (paid according to a predetermined paytable not shown).

Figure 7:
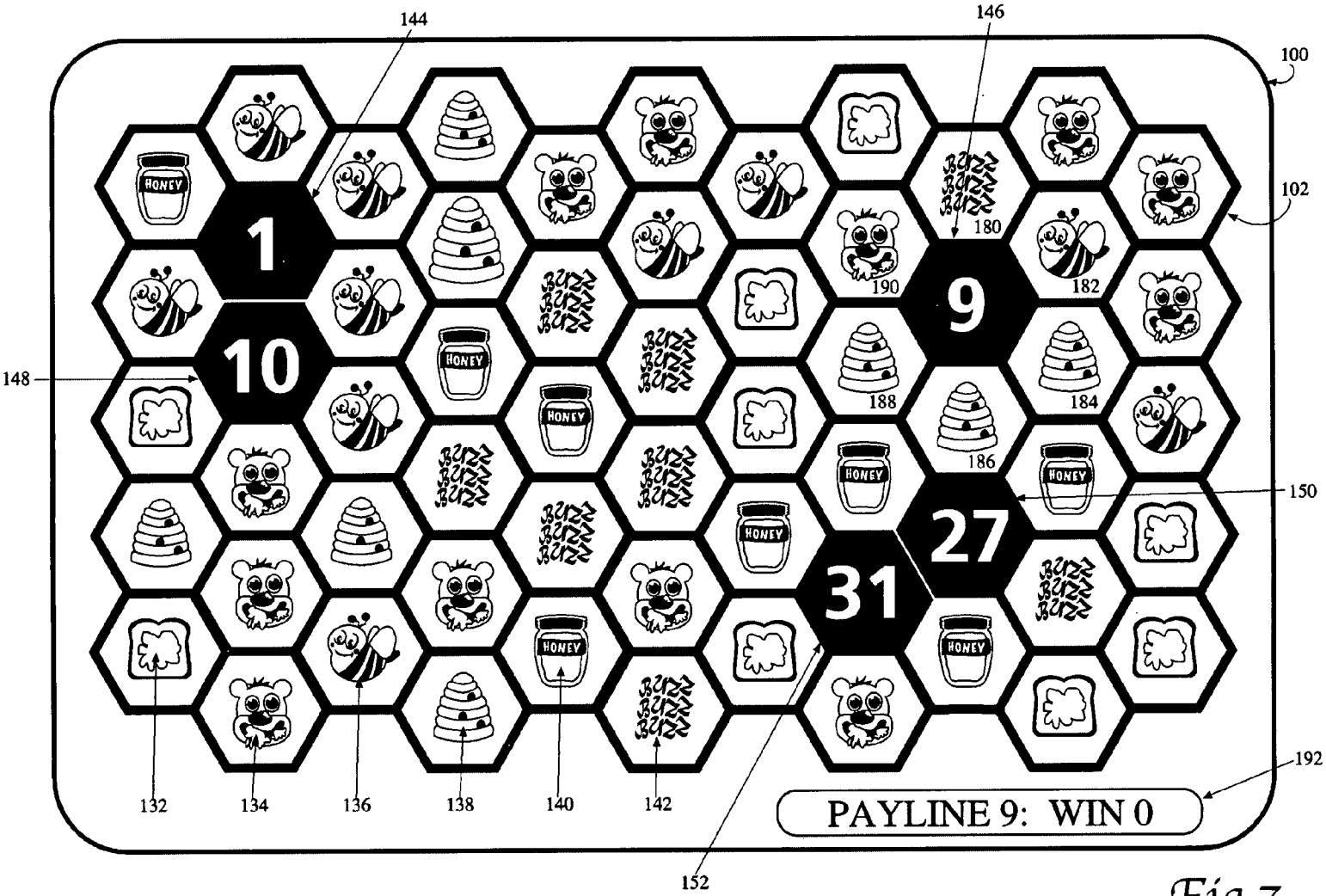
FIG. 7 shows the second special symbol indicating and activating its corresponding payline.

FIG. 7 refers to the game elements shown in FIG. 5 with special symbol "9" 146 indicating and activating Payline 9 comprising symbol boxes 180, 182, 184, 186, 188 and 190. The first symbol box in Payline 9 180 contains a Buzz-Buzz, the second symbol box 182 contains a Mr. Bee, the third symbol box 184 contains a Beehive, the fourth symbol box 186 contains a Beehive, the fifth symbol box 188 contains a Beehive, and the sixth symbol box 190 contains a Honey Bear. There are no wins on Payline 9 192.

Figure 8:
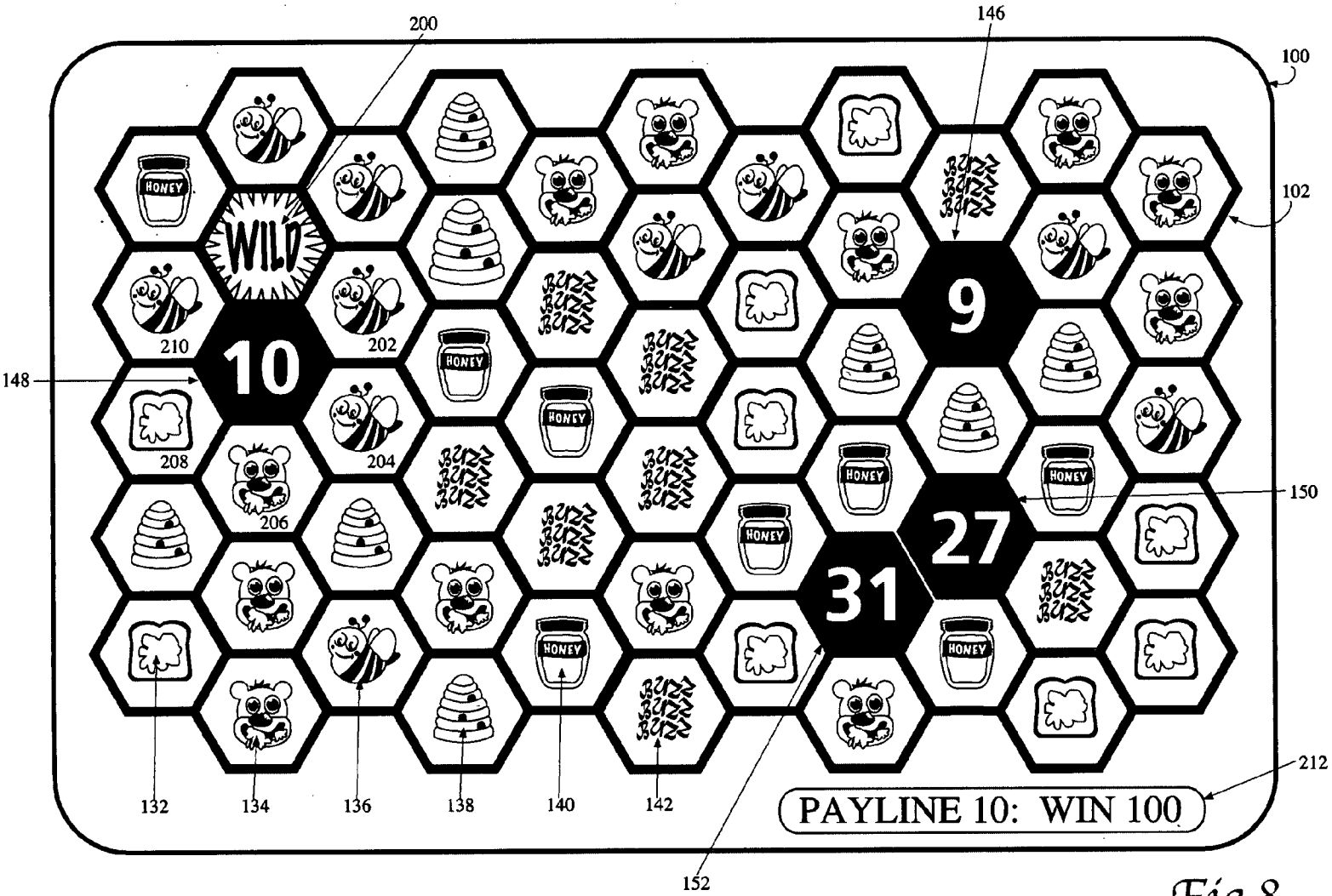
FIG. 8 shows the third special symbol indicating and activating its corresponding payline.

FIG. 8 refers to the game elements shown in FIG. 5 with special symbol "10" 148 indicating and activating Payline 10 comprising symbol boxes 200, 202, 204, 206, 208 and 210. The first symbol box in Payline 10 200 is special symbol "1" (activating Payline 1) that has been changed to a Wild symbol in Payline 10, the second symbol box 202 contains a Mr. Bee, the third symbol box 204 contains a Mr. Bee, the fourth symbol box 206 contains a Honey Bear, the fifth symbol box 208 contains a Honey Toast, and the sixth symbol box 210 contains a Mr. Bee. The player wins 100 credits for three Mr. Bees on Payline 10 212 (paid according to a predetermined paytable not shown).

Figure 9:
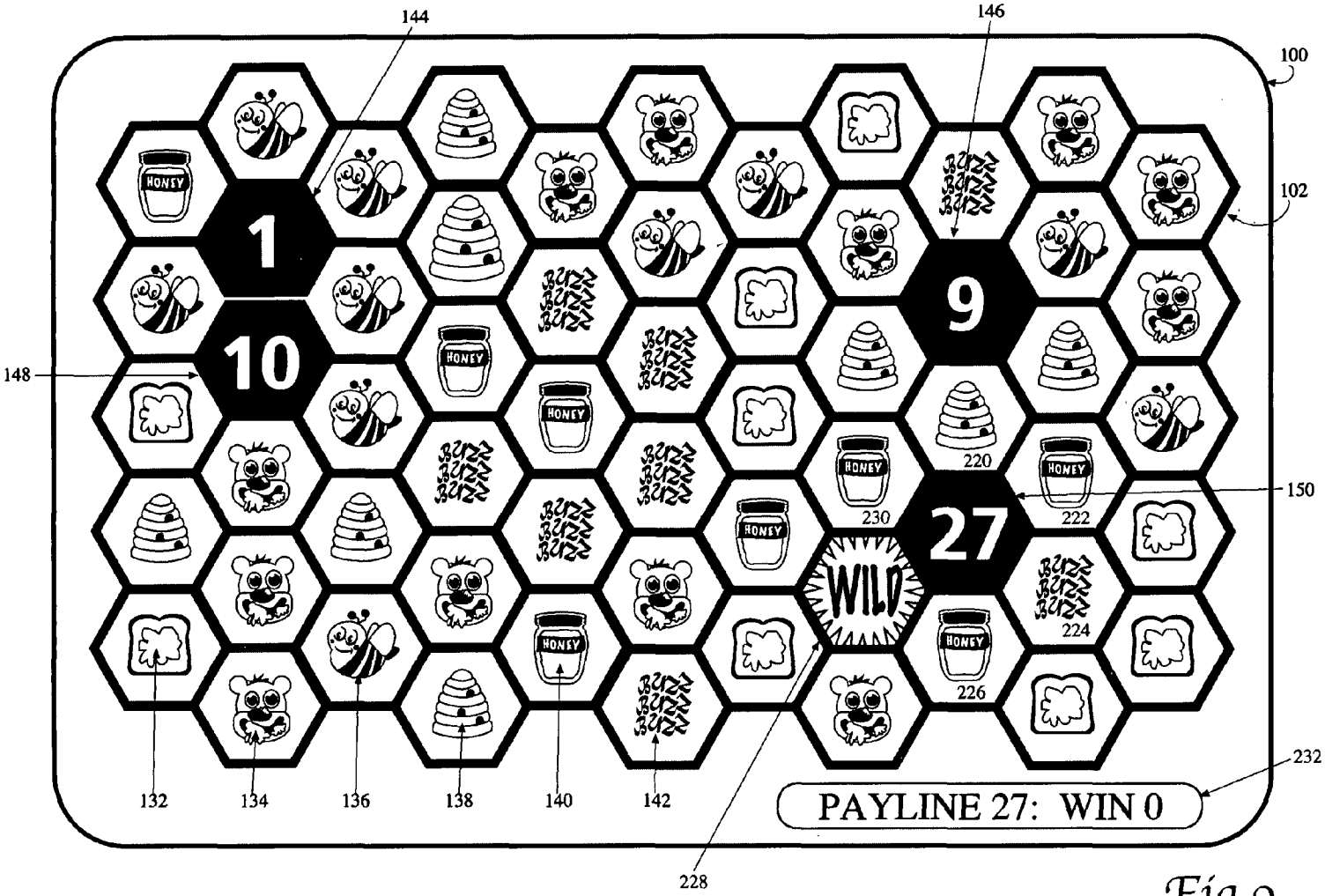
FIG. 9 shows the fourth special symbol indicating and activating its corresponding payline.

FIG. 9 refers to the game elements shown in FIG. 5 with special symbol "27" 150 indicating and activating Payline 27 comprising symbol boxes 220, 222, 224, 226, 228 and 230. The first symbol box in Payline 27 220 contains a Beehive, the second symbol box 222 contains a Honey Jar, the third symbol box 224 contains a Buzz-Buzz, the fourth symbol box 226 contains a Honey Jar, the fifth symbol box 228 is special symbol "31" (activating Payline 31) that has been changed to a Wild symbol in Payline 27, and the sixth symbol box 230 contains a Honey Jar. There are no wins on Payline 27 232.

Figure 10:
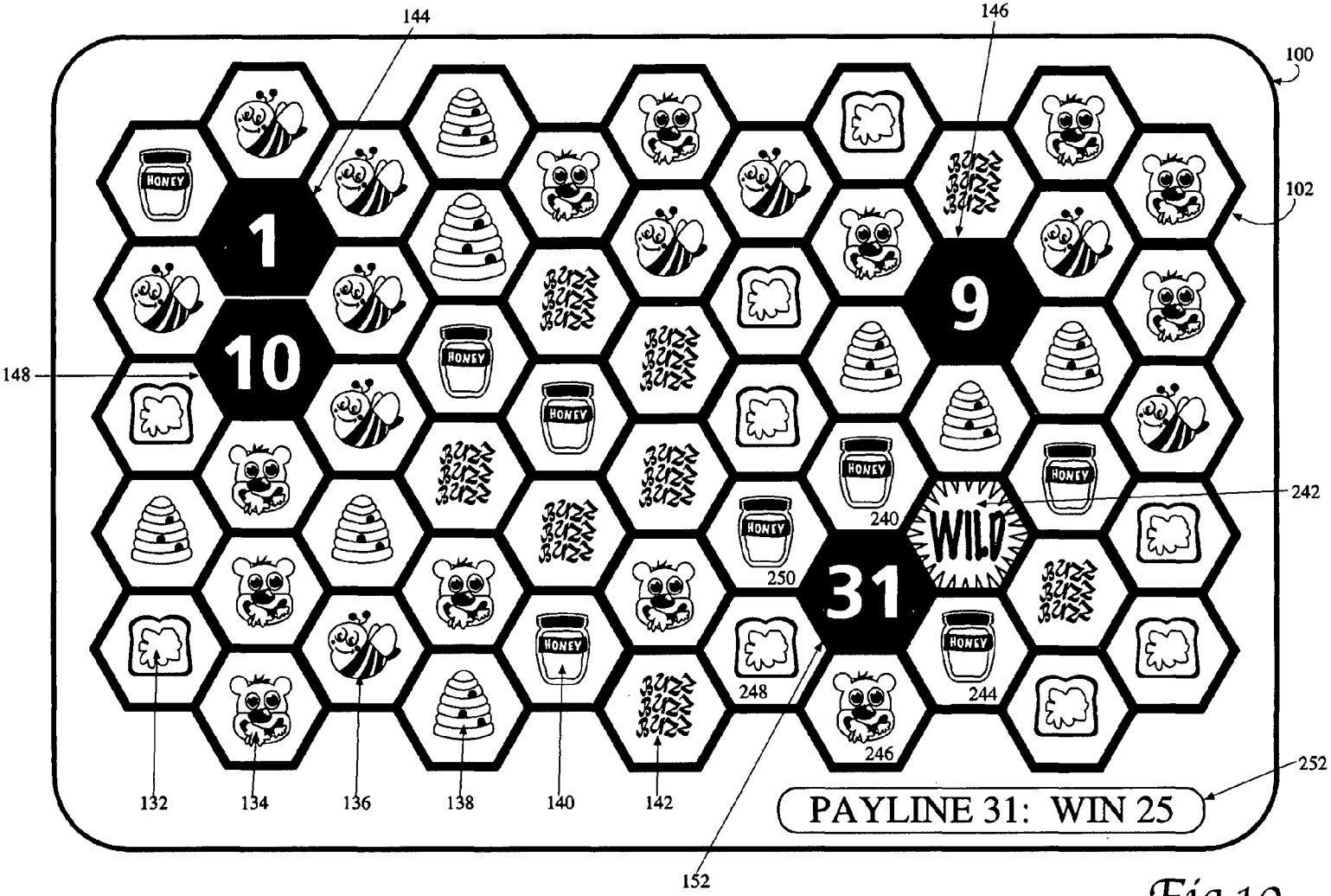
FIG. 10 shows the fifth special symbol indicating and activating its corresponding payline.

FIG. 10 refers to the game elements shown in FIG. 5 with special symbol "31" 152 indicating and activating Payline 31 comprising symbol boxes 240, 242, 244, 246, 248 and 250. The first symbol box in Payline 31 240 contains a Honey Jar, the second symbol box 242 is special symbol "27" (activating Payline 27) that has been changed to a Wild symbol in Payline 31, the third symbol box 244 contains a Honey Jar, the fourth symbol box 246 contains a Honey Bear, the fifth symbol box 248 contains a Honey Toast, and the sixth symbol box 250 contains a Honey Jar. The player wins 25 credits for three Honey Jars on Payline 31 252 (paid according to a predetermined paytable not shown).

Figure 11:
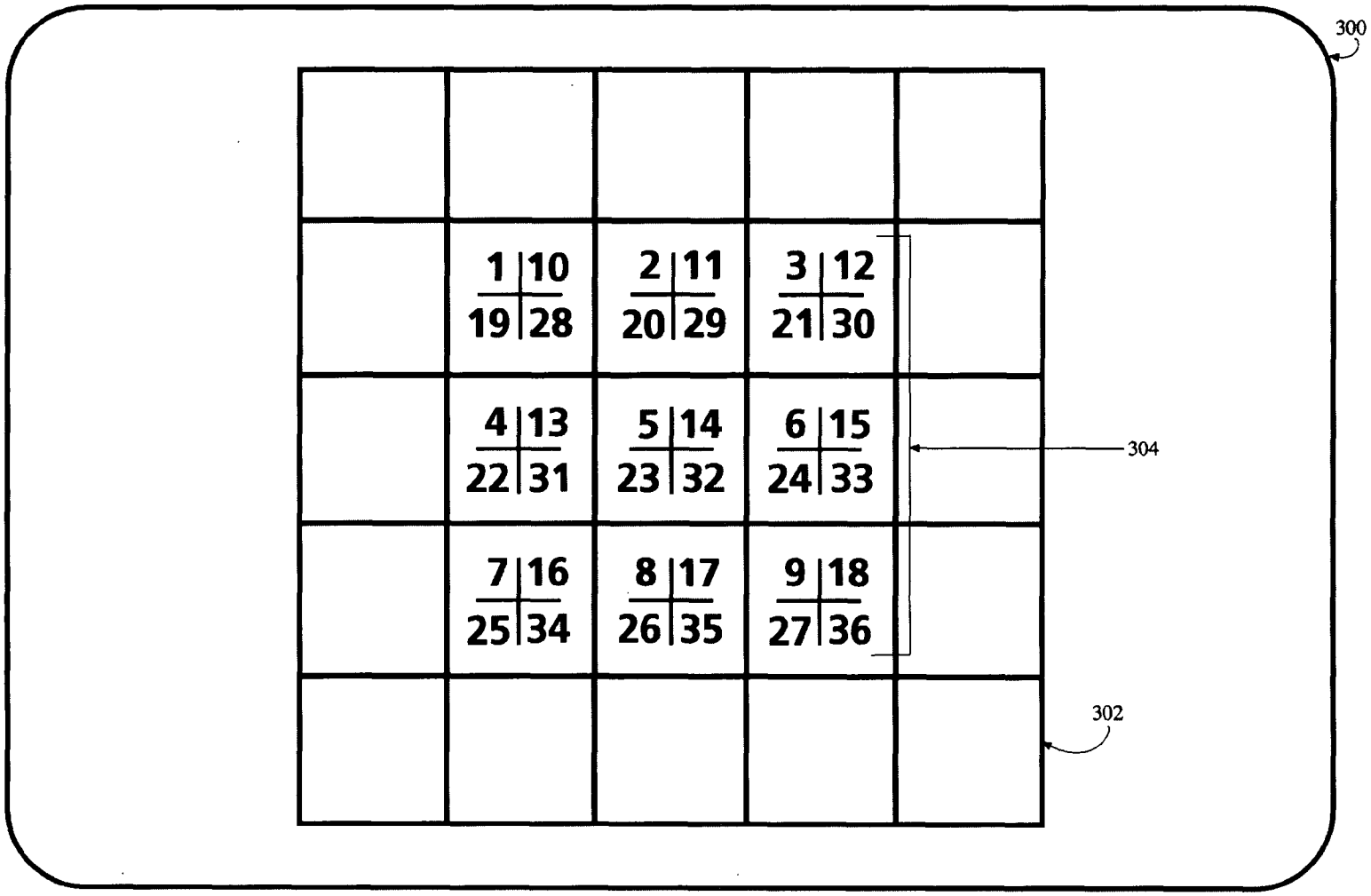
FIG. 11 shows a monitor screen of a slot machine with a depiction of nine potential payline indicator symbol boxes.

FIG. 11 illustrates the third embodiment of the present invention and shows a slot machine monitor screen 300 with a square grid 302 comprised of twenty-five square symbol boxes. Nine of the symbol boxes are potential payline indicator symbol boxes 304 as each is adjacently fully surrounded by eight symbol boxes. Each potential payline indicator symbol box is labeled with four numbers, representing four paylines.

Figure 12:
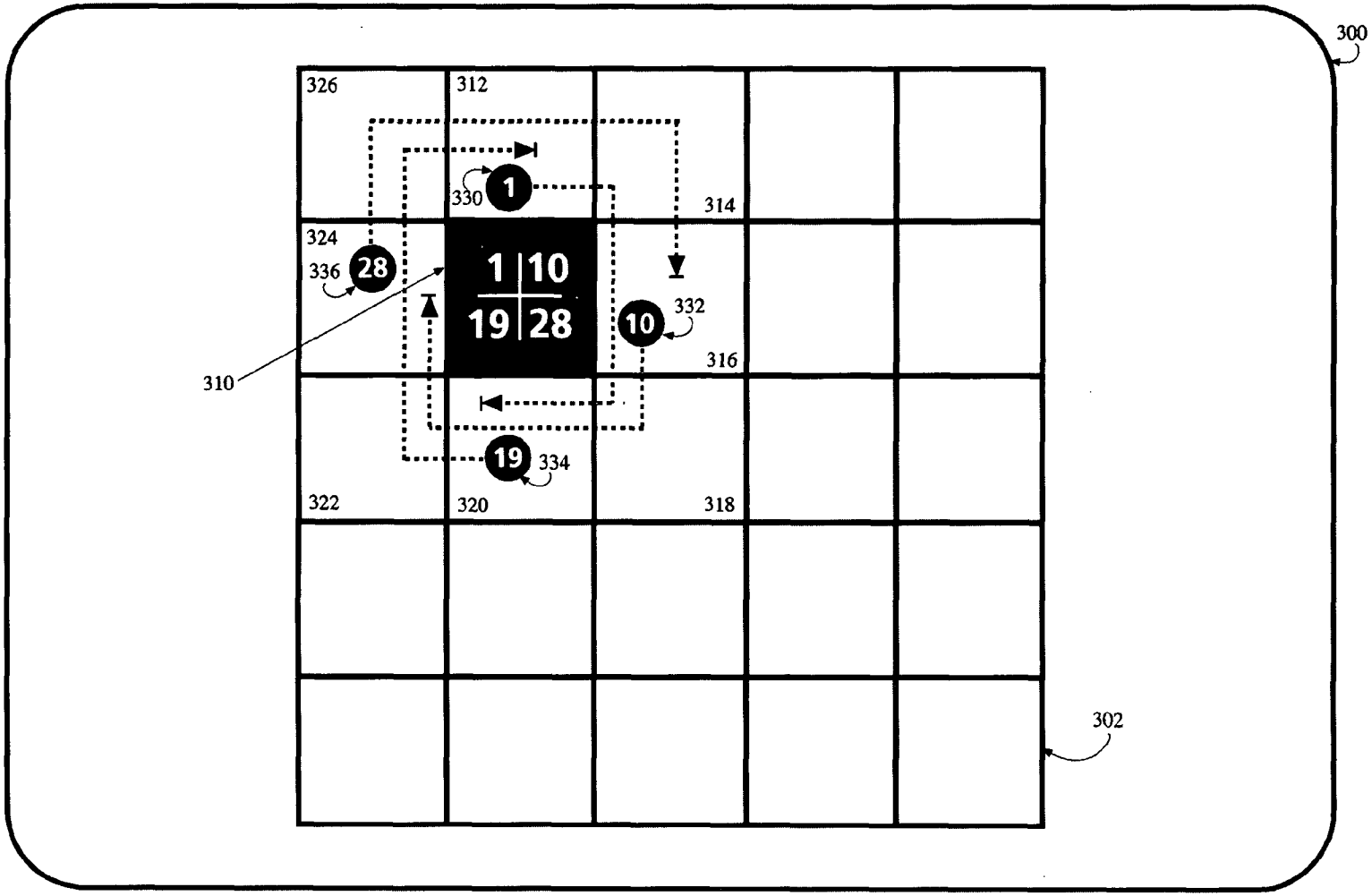
FIG. 12 shows the monitor screen of the slot machine with an illustrative example of a special symbol and its corresponding four activated paylines each comprising five symbol areas.

FIG. 12 refers to the game elements shown in FIG. 11 and displays exemplary payline configurations. A special symbol (solid black square designated by white type "1", "10", "19", and "28") 310 acts first as a payline indicator for four paylines, and is designated by white type "1", "10", "19", and "28" since it has been placed in the potential payline indicator symbol box "1/10/19/28". Four corresponding activated paylines are shown, each comprising five of the eight surrounding symbol boxes (312, 314, 316, 318, 320, 322, 324, 326). Payline 1 330 comprises (in order) symbol boxes 312, 314, 316, 318, 320; Payline 10 332 comprises (in order) symbol boxes 316, 318, 320, 322, 324; Payline 19 334 comprises (in order) symbol boxes 320, 322, 324, 326, 312; and Payline 28 336 comprises (in order) symbol boxes 324, 326, 312, 314, 316.

Although specific examples and specific images have been provided in this discussion, these specifics are intended to be only support for the generic concepts of the invention and are not intended to be absolute limits in the scope of the technology discussed.

What is claimed:

1. A method of playing a video wagering game on a video gaming apparatus, the apparatus having at least one processor, at least one input device, memory and video display screen, the method comprising:

accepting, by the processor, a wager in response to the at least one input device of the video wagering game in order for the wager to be eligible to activate an at least one payline;

displaying on the video display screen a grid comprising a predetermined amount of connected identical symbol boxes;

designating each symbol box that is fully surrounded by adjacent symbol boxes as a potential payline indicator symbol box;

providing a random array of symbols within the symbol boxes from a predetermined set of symbols used in the play of the wagering game;

wherein the predetermined set of symbols includes at least one special symbol;

wherein if a special symbol is provided in a potential payline indicator symbol box, that said special symbol comprises a dual functionality;

wherein a first functionality of the special symbol is to act as a non-valuable payline indicator symbol that determines one payline and activates said payline if a wager has been placed on said payline;

wherein a second functionality of the special symbol is to act as a valuable enhanced symbol in any activated payline differing from the one payline determined by said one payline's payline indicator functionality; and evaluating the symbol array, wherein any wins are paid according to a predetermined paytable.

2. The method of claim 1 wherein the grid comprises hexagonal symbol boxes.

3. The method of claim 2 wherein each payline comprises exactly six connecting hexagonal symbol boxes that fully surround a hexagonal symbol box acting as a potential payline indicator symbol box.

4. The method of claim 3 wherein all paylines comprise identical configurations of connecting hexagonal symbol boxes and are positioned similarly around the hexagonal symbol box acting as a potential payline indicator symbol box in respect to the position of the first symbol of each payline.

5. The method of claim 1 wherein the special symbol is an alphanumeric symbol.

6. The method of claim 1 wherein the wager automatically activates the at least one payline.

7. The method of claim 1 wherein the valuable enhanced symbol acts at least as a wild, multiplier, a wild multiplier, scatter and/or bonus symbol.

8. A method of playing a video wagering game on a video gaming apparatus, the apparatus having at least one processor, at least one input device, memory and video display screen, the method comprising:

accepting, by the processor, a wager in response to the at least one input device of the video wagering game in order for the wager to be eligible to activate an at least one payline;

displaying on the video display screen a grid comprising a predetermined amount of connected identical symbol boxes;

designating each symbol box that is fully surrounded by adjacent symbol boxes as a potential payline indicator symbol box;

providing a random array of symbols within the symbol boxes from a predetermined set of symbols used in the play of the wagering game;

wherein the predetermined set of symbols includes at least one special symbol;

wherein if a special symbol is provided in a potential payline indicator symbol box, that said special symbol comprises a dual functionality;

wherein a first functionality of the special symbol is to act as a non-valuable payline indicator symbol that determines at least one payline and activates that said at least one payline if a wager has been placed on that said at least one payline;

wherein a second functionality of the special symbol is to act as a valuable enhanced symbol in any activated payline differing from the at least one payline determined by said one payline's payline indicator functionality; and evaluating the symbol array, wherein any wins are paid according to a predetermined paytable.

9. The method of claim 8 wherein the grid comprises hexagonal symbol boxes.

10. The method of claim 9 wherein each payline comprises at least two connecting hexagonal symbol boxes from exactly six connecting hexagonal symbol boxes that fully surround a hexagonal symbol box acting as a potential payline indicator symbol box.

11. The method of claim 10 wherein all paylines comprise identical configurations of connecting hexagonal symbol boxes and are positioned differently around the hexagonal symbol box acting as a potential payline indicator symbol box in respect to the position of the first symbol of each payline.

12. The method of claim 8 wherein the grid comprises square symbol boxes.

13. The method of claim 12 wherein each payline comprises exactly eight connecting square symbol boxes from exactly eight connecting square symbol boxes that fully surround a square symbol box acting as a potential payline indicator symbol box.

14. The method of claim 13 wherein all paylines comprise similar configurations of connected square symbol boxes and are positioned differently around the square symbol box acting as a potential payline indicator symbol box in respect to the position of the first symbol of each payline.

15. The method of claim 8 wherein the valuable enhanced symbol acts at least as a wild, multiplier, a wild multiplier, scatter and/or bonus symbol.

16. The method of claim 8 wherein the special symbol is an alphanumeric symbol.

17. The method of claim 8 wherein the wager automatically activates the at least one payline.

* * * * *